US007681737B2

(12) United States Patent
Armstrong et al.

(10) Patent No.: US 7,681,737 B2
(45) Date of Patent: Mar. 23, 2010

(54) MAGNETIC SEPARATOR APPARATUS

(75) Inventors: Peter David Armstrong, Bridgend (GB); Jonathan Ashley Brinson, Crestwood, KY (US); Stephen John Dobney, Gwent (GB); Steven Fawell, Cardiff (GB); Paul Genner, Gwent (GB); Frank Edward Perrin, Barry (GB); David William Snodgrass, Madison, IN (US)

(73) Assignee: Dow Corning Corporation, Midland, MI (US)

( * ) Notice: Subject to any disclaimer, the term of this patent is extended or adjusted under 35 U.S.C. 154(b) by 672 days.

(21) Appl. No.: 10/559,399

(22) PCT Filed: Jun. 8, 2004

(86) PCT No.: PCT/US2004/018074

§ 371 (c)(1),
(2), (4) Date: Jun. 16, 2006

(87) PCT Pub. No.: WO2004/110635

PCT Pub. Date: Dec. 23, 2004

(65) Prior Publication Data

US 2007/0023326 A1 Feb. 1, 2007

Related U.S. Application Data

(60) Provisional application No. 60/476,978, filed on Jun. 9, 2003.

(51) Int. Cl.
*B03C 1/00* (2006.01)

(52) U.S. Cl. ..... 209/225; 209/212; 209/213; 209/214; 209/215

(58) Field of Classification Search ..... 209/225, 209/212, 213, 214, 215
See application file for complete search history.

(56) References Cited

U.S. PATENT DOCUMENTS

| | | | | |
|---|---|---|---|---|
| 2,074,085 | A * | 3/1937 | Frantz | 209/224 |
| 2,326,575 | A * | 8/1943 | Stearns | 209/219 |
| 2,372,665 | A | 3/1945 | Wulff | |
| 2,766,887 | A * | 10/1956 | Atwood | 209/636 |
| 3,567,026 | A | 3/1971 | Kolm | |
| 3,676,337 | A * | 7/1972 | Kolm | 210/695 |
| 4,000,060 | A | 12/1976 | Collin | |
| 4,087,358 | A | 5/1978 | Oder | |
| 4,353,730 | A | 10/1982 | Dijkuis | |

(Continued)

FOREIGN PATENT DOCUMENTS

EP 0951940 A2 10/1999

OTHER PUBLICATIONS

Dev.in Mineral Processing, NY/1987, "Magnetic Methods for the Treatment of Minerals", ISBN-44-42811-9.

(Continued)

*Primary Examiner*—Patrick Mackey
*Assistant Examiner*—Terrell H Matthews
(74) *Attorney, Agent, or Firm*—Howard & Howard Attorneys PLLC

(57) ABSTRACT

Magnetic separator devices that are useful in separating finely divided solids in the presence of liquids, vapors, and gases that are hazardous, that is, they may be corrosive, flammable, toxic, or a combination of such hazards, and the use of such devices in processes for the manufacture of chlorosilanes.

12 Claims, 9 Drawing Sheets

U.S. PATENT DOCUMENTS

| | | | | |
|---|---|---|---|---|
| 4,359,379 | A | 11/1982 | Ushio et al. | |
| 4,406,773 | A | 9/1983 | Hettinger | |
| 4,836,914 | A | 6/1989 | Inoue | |
| 5,147,527 | A | 9/1992 | Hettinger | |
| 5,190,635 | A | 3/1993 | Goolsby | |
| 5,520,797 | A | 5/1996 | Ino et al. | |
| 5,972,208 | A | 10/1999 | Goolsby | |
| 6,059,959 | A | 5/2000 | Goolsby | |
| 6,149,014 | A * | 11/2000 | Mankosa et al. | 209/223.2 |
| 6,253,924 | B1 * | 7/2001 | Bleifuss et al. | 209/223.1 |
| 6,262,843 | B1 | 7/2001 | Wiesner | |
| 6,299,174 | B1 * | 10/2001 | Kotlyar | 277/358 |
| 6,422,568 | B1 * | 7/2002 | Kotlyar | 277/377 |
| 2006/0016732 | A1 * | 1/2006 | Franzreb et al. | 209/232 |
| 2007/0023326 | A1 * | 2/2007 | Armstrong et al. | 209/39 |

OTHER PUBLICATIONS

Perry'sChemical Eng. Handbook, NY/1998, "Magnetic Separation", 7th Ed., pp. 19-49.

Kirk-Othmer Enc of Chem. Tech., NY/1978, 3rd Edition, vol. 15, pp. 708-732.

* cited by examiner

MAGNETIC SEPARATOR APPARATUS

What is disclosed and claimed herein are magnetic separator devices that are useful in separating finely divided solids, liquids, vapors, and gases that are hazardous, that is, they may be corrosive, flammable, toxic, or a combination of such hazards and the use of such devices in the manufacture of chlorosilanes. This application claims priority from Provisional Patent application 60/476,978, filed on Jun. 9, 2003 and International Application No. PCT/US2004/018074, filed on Jun. 8, 2004.

BACKGROUND OF THE INVENTION

Magnetic separation is well described in the literature. Jan Svoboda has reviewed the state of magnetic separation technology in "Magnetic Methods for the Treatment of Minerals", Developments in Mineral Processing-8, ISBNO-44-42811-9, Elsevier, N.Y., 1987. Other general references include "Magnetic Separation", Perry's Chemical Engineers' Handbook, McGraw-Hill, New York, 7$^{th}$ Edition, 1998, pp. 19-49 and John Oberteuffer and Ional Wechsler, "Magnetic Separation", Kirk-Othmer Encyclopedia of Chemical Technology, 3$^{rd}$ edition, 1978, John Wiley & Sons, New York, Volume 15, pp. 708-732.

Several patents have issued dealing with vibrating matrix separators, namely, Frantz, in U.S. Pat. No. 2,074,085, that issued Mar. 16, 1937 describes a magnetic separator for fine powders. Frantz disclosed that separators based on the use of pulleys, rotors or belts are unable to make efficient separations when fed fine powders. Frantz's magnetic separator consists of an electromagnetic solenoid, a casing vessel and attractor screens as the matrix. In one embodiment of the invention, the matrix is vibrated by means of an eccentric weight fixed to a vertical shaft that is rotated by a motor.

Mechanical means is not the only method of vibrating the matrix; it is also possible by electromagnetic means. Kolm discloses in U.S. Pat. No. 3,567,026 that issued Mar. 2, 1971 and U.S. Pat. No. 3,676,337 that issued Jul. 11, 1972 the vibration of a fine steel wool matrix in a direct current solenoid separator using alternating current coils. Both Kolm patents describe a magnetic separator that includes one direct current coil and three alternating current coils. The direct current coil provides the background magnetic field that magnetizes the steel wool matrix to perform the main separation. The first alternating current coil is a demagnetizing coil to remove residual magnetization from the direct current coil. The other two alternating current coils create an eddy current to vibrate the steel wool matrix to shake loose retained components. A process is claimed for switching off the direct current field and applying the alternating current fields to flush magnetic fines out of the matrix. In addition to ferromagnetic wool, copper wool is optionally added to intensify the vibration. The eddy current is in the upper sonic range on the order of 18,000 to 20,000 cycles per second, and up. Perforated plates can optionally be used for flow distribution.

Although the Kolm patents are chiefly concerned with wet slurries, dry particulate removal is also contemplated from a stream such as fly ash contained in smoke from a power station.

Oder, in U.S. Pat. No. 4,087,358, that issued May 2, 1978 describes methods and apparatus for vibrating the matrix of a clay slurry magnetic separator to dislodge impurities during the flushing step of the operation. Vibratory hammering, shaking the matrix by auxiliary alternating current coils, and the use of high intensity sound, are suggested means of applying auxiliary mechanical forces to the matrix.

Wulff, in U.S. Pat. No. 2,372,665, that issued Mar. 20, 1945 describes a method of separating white cast iron powder into pearlite-rich and carbide-rich fractions by heating the mixed feed to 215° C. so that the carbide particles are above their Curie temperature and therefore not attracted to the magnetic field.

Collin in U.S. Pat. No. 4,000,060 that issued Dec. 28, 1976 describes a magnetic separator for hot powder mixtures. The separator consists of a drum roll separator with water-cooled permanent magnets. The non-magnetic rollers are set in a temperature controlled fluidized bed. The feed powder is fluidized with an inert gas such as nitrogen.

Inoue in U.S. Pat. No. 4,836,914, that issued Jun. 6, 1989, describes a process using a magnetic separator to remove iron particles from petroleum oil. The preferred temperature of operation is up to 400° C. This method has advantages over other treatment alternatives such as hydroxide treatment. It is especially advantageous for high viscosity oils.

Sometimes it is desirable to heat the matrix to aid in cleaning it between cycles. Dijkuis in U.S. Pat. No. 4,353,730 that issued on Oct. 5, 1982 describes a method for cleaning a magnetic separator matrix by heating a cleaning fluid above the Curie temperature of the matrix material in order to release magnetic fines.

There is disclosed an example of magnetic separation involving particles that are abrasive in U.S. Pat. No. 6,262,843, that issued on Jul. 24, 2001 to Wiesner in which it is taught how to remove impurities from the machining of semiconductor material wherein particles from saw blades or lapping plates can be magnetically separated from the cutting fluid used during the machining process for silicon.

Hazardous powders are those finely divided solids that are corrosive, flammable, toxic, or a combination of such hazards. Powders that are inherently hazardous must be completely contained inside the magnetic separator apparatus with a highly reliable leakage prevention design. Sometimes, hazardous dry powders are processed simultaneously with hazardous gases, vapors, or liquids. The hazardous fluids also contribute to the difficulty of operating a magnetic separator on such powders.

Confining such materials within the separator is very important. Small leaks of corrosive materials can result in corrosion failures of the containment vessel that lead to large, even catastrophic leaks. Corrosive and toxic materials can injure employees. Flammable materials can cause fires and explosions when they leak from a contained, inert environment to the atmosphere. Thus, the integrity and reliability of the containment system is very critical.

Additional problems are introduced when the separation is made at higher than ambient temperatures, higher than ambient pressures or when the solids are especially abrasive. High temperature operations make it impossible to use many polymer or elastomer materials that are available at lower temperatures. These materials might be the preferred material of construction for corrosion or abrasion resistance properties. At high temperatures, many polymers and elastomers are seriously weakened and thus fail in operation.

Pressure adds to this problem if the materials of construction are used for pressure containment or sealing. Loss of containment during operation above ambient pressure permits rapid leakage of process materials out of the separator to the atmosphere, thus creating a hazardous incident such as a fire or explosion. Similar hazards can be created inside the separator if it operates at vacuum so that air is drawn into the device on loss of containment. In addition to hazardous consequences on loss of containment, quality problems might also result on a process. An example would be a process where oxygen is a contaminant and the magnetic separator is operating under vacuum.

Abrasion of materials of construction of the apparatus is also a problem. The containment vessel can be eroded resulting in loss of containment. Seals are especially prone to containment failure, so avoidance of rotating mechanical seal faces or similar design features is critical. Detection of failures is also highly desirable.

There are many types of magnetic separators in industrial today. Several types of high gradient magnetic separators are known to the inventors herein. One is an enclosed belt separator including the MagnaCat® separator manufactured by Merrichem Company, located in Houston, Tex.

In U.S. Pat. No. 4,406,773, Hettinger et al. describe the use of a Sala high gradient carousel magnetic separator to separate samples of catalyst mixed with water. It is presumed that this separation of the slurry is made near ambient temperature. In U.S. Patent 5,147,527, Hettinger describes the use of a belt roller magnetic separator, especially the Eriez Magnetic Rare Earth Roll Permanent Magnetic Separator fitted with an electrostatically conductive belt. Separation is contrasted with an Eriez high gradient magnetic separator, but throughput of the high gradient magnetic separator was limited. In U.S. Pat. No. 5,190,635, a preferred process is described wherein the catalyst magnetic susceptibility and Curie temperature are controlled by processing conditions. In U.S. Pat. No. 5,985,134, a preferred separation temperature of up to 260° C. is stated. In U.S. Pat. Nos. 5,972,208 and 6,059,959, the optional use of a catalyst cooler is described to reduce the catalyst temperature from preferred regenerator temperature of about 700° C. to a cooled temperature of 38° C. to 260° C. Goolsby and Kowalczyk in EP 0951940 A2 disclose a preferred samarium/cobalt magnet to allow efficient operation up to 232° C. (450° F.) "without extensive cooling equipment".

Another modern version of the catalyst separator has been developed by Nippon Oil Company. Ushio and co-workers in U.S. Pat. No. 4,359,379 that issued Nov. 16, 1982 describes magnetic separation of the catalyst using a Sala high gradient magnetic separator with a ferromagnetic matrix. As noted therein, the inventors note that the drum-type magnetic separator can remove iron dust, but is "useless" in separating the metal deposited catalyst. In some examples, air is used as a carrier fluid in the high gradient magnetic separator. There is no indication therein that the separations were made at high temperature, and one example shows operation at room temperature. Ino and co-workers in U.S. Pat. No. 5,520,797 that issued on May 28, 1996 also used a Sala high gradient magnetic separator with a ferromagnetic matrix and gas carrier. These devices have problems that limit their effectiveness and usefulness for magnetically separating hazardous dry powders.

The belt separator device can be enclosed in a pressure tight (or nearly pressure tight) containment vessel. Such a device is described in the U.S. Patents to Hettinger, Goolsby and co-workers. Such devices are presently marketed under the trade name of MagnaCat to separate fluidized catalytic cracker catalysts. The belt separator has certain disadvantages. Since the feed powder lies on a belt during the separation processing, particle-to-particle attraction forces interfere with the magnetic attraction forces. Therefore, particle cohesion and static electricity can make magnetic and non-magnetic particles stick to each other. When this happens, it is difficult to separate the particles into magnetic and non-magnetic streams. Another problem with such devices is belt wear. When the belt wears due to degradation, corrosion, abrasion or stretching, it must be replaced. This is especially difficult if the process is hazardous. In addition to natural particle attractions, the belt can actually increase particle-to-particle forces. Static electricity can build up on a rotating belt device, especially if the belt is a non-conducting elastomer. As indicated Supra, the belt separator can be enclosed in a containment vessel.

Another type of separator is the matrix/canister high gradient magnetic separator. Due to its matrix construction, this separator has intense local magnetic gradients that improve separation. By vibrating the device, particle-to-particle interactions are minimized. One method used to vibrate the device is to connect the canister with a flexible rubber boot around the full diameter of the canister. Such a rubber boot, however, is problematic with corrosive materials and hot, pressurized processing conditions. Operation of the device above ambient pressure is also difficult because the flexible boot tends to expand due to the internal pressure. This type of boot is also difficult to make reliable because it is as large as the diameter of the canister. For a twelve inch canister, the boot must be a minimum of twelve inches in diameter. The entire high gradient magnetic separator can be installed in a pressure tight container, but this adds to the capital expense of the equipment, and it adds to the complexity of maintenance operations.

The apparatus of the invention disclosed herein is a vibrating matrix, high gradient magnetic separator. It can process powders, vapors, liquids and gases that are corrosive, flammable or toxic. It permits operation at above ambient temperature and above ambient pressure. It is especially suitable for highly abrasive fine powders. It also provides for safe containment of process hazards.

The processes set forth herein are processes for manufacturing chlorosilanes.

THE INVENTION

Figure 1:
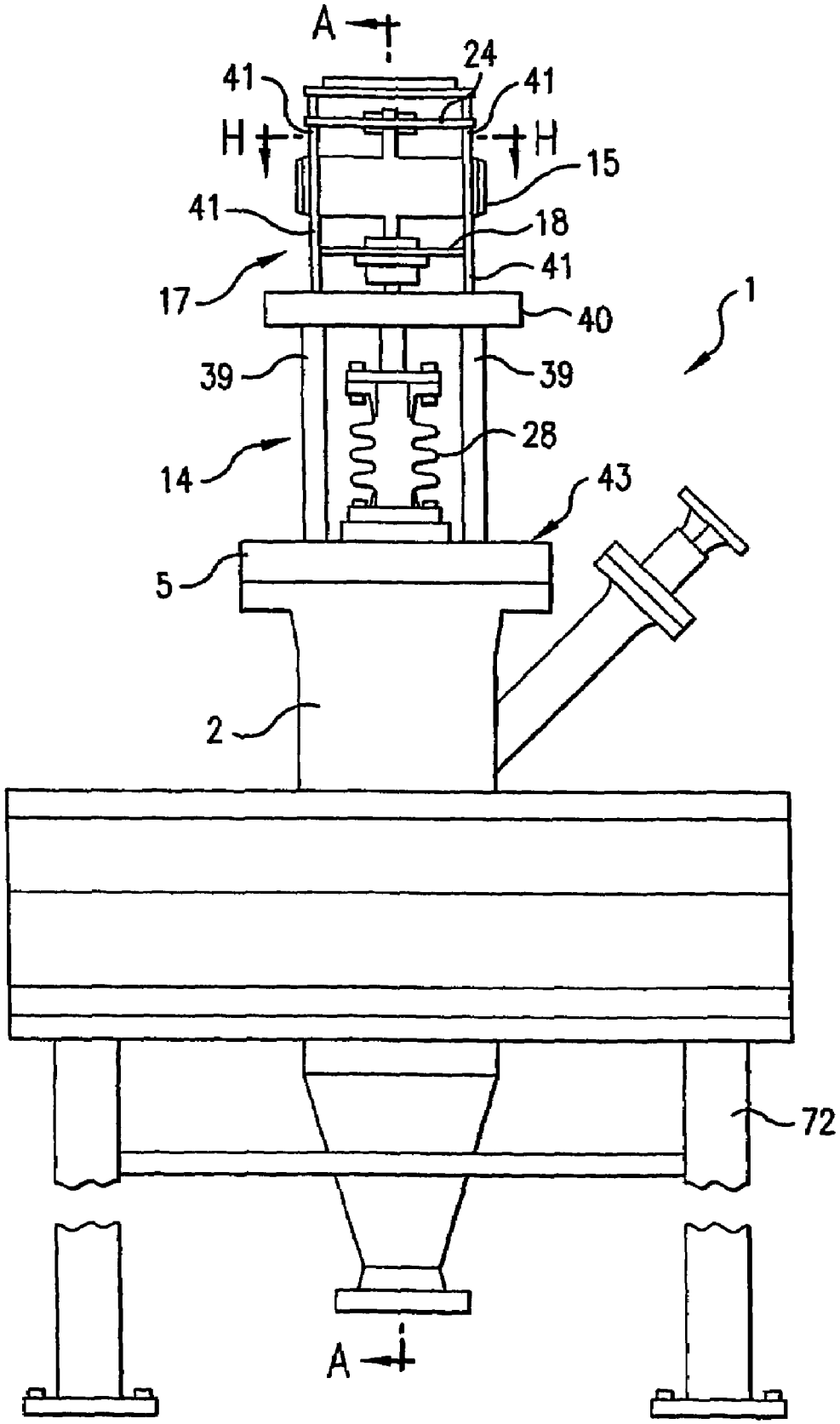
FIG. 1 is a full front view of one embodiment of a separator of this invention sitting on a support stand.

What is disclosed and claimed herein is a vibrating magnetic separator having vibrating components and stationary components wherein the vibrating magnetic separator contains a flexible bellows to seal the processed materials inside the separator.

With further specificity, there is a vibrating magnetic separator comprising in combination an electromagnet; a pressure vessel having an inlet and an outlet, wherein the pressure vessel is mounted in the electromagnet such that the electromagnet essentially surrounds a portion of the pressure vessel; a ferromagnetic matrix; a vibrator for vibrating the ferromagnetic matrix wherein the vibrator moves the matrix in a vertical direction and, a bellows that connects and seals the stationary components of the magnetic separator to the vibrating components of the magnetic separator.

One embodiment of the invention disclosed and claimed herein is a magnetic separator apparatus comprising in combination a pressure vessel container having a top half, a lower half, and a lower half terminus. The pressure vessel container is surmounted by a pressure vessel lid flange and has a vertical wall. The pressure vessel lid flange has a centered opening through it wherein there is located a shaft and shaft seal.

There is at least one feed nozzle mounted on the pressure vessel container for feeding material to the pressure vessel container, and there is a matrix located in the lower half of the pressure vessel container, the matrix being supported in the pressure vessel container by a shaft. Depending partly on the material to be separated, there can be two or more feed nozzles.

There is an electromagnetic apparatus encircling the pressure vessel container on the outside of the pressure vessel container wall and at the location of the matrix. In addition, there is a layer of thermal insulation located between the electromagnetic apparatus and the pressure vessel container wall to insulate the pressure vessel container.

A first support mechanism is mounted on the pressure vessel lid flange for supporting a vibrator mounting frame and the vibrator mounting frame has a centered opening through it. There is a second support mechanism surmounted on the vibrator mounting frame for supporting at least one lower control spring, wherein the second support mechanism also supports a magnet vibrator casing containing a vibrator. The vibrator and vibrator casing have centered openings through them to accommodate a unitary vertical shaft described infra.

Surmounted on the vibrator casing is a third support mechanism and mounted on the third support mechanism is a support plate and surmounted thereon is a fourth support mechanism. The fourth support mechanism has surmounted on it at least one upper control spring having an upper surface.

There is a unitary moveable vertical shaft having a lower end and an upper end and the unitary moveable vertical shaft is connected at its lower end to the matrix. The unitary moveable vertical shaft extends upwardly through the shaft seal and the pressure vessel lid flange centered opening and extends upwardly through the center of a bellows, and continues to extend upwardly through the vibrator mounting frame centered opening and continuing extending upwardly through the lower control spring, through the vibrator centered opening and then extending upwardly through the upper control spring and terminating above the upper surface of the upper control spring and below an end plate.

There is a containment bellows surmounted on the pressure vessel lid flange, and the bellows is attached to a flange which is integral to the unitary moveable vertical shaft.

There is a clean gas purge apparatus comprising a clean gas purge inlet located in the pressure vessel lid flange that opens into a purge space formed by the shaft seal as the floor, the pressure vessel lid flange as the side and the containment bellows as the top. The clean gas purge prevents dust from collecting between the convolutions of the bellows. It also prevents condensable liquids from collecting in the bellows if vapors are present. Thus, the clean gas purge prevents obstruction of the free movement of the bellows. The clean gas can be any dirt-free gas. It can be an inert gas such as nitrogen. Where the shaft seal meets the unitary vertical shaft inert gas is allowed to leak into the pressure vessel container at a low flow rate thereby preventing the ingress of particles into the seal and bellows.

The pressure vessel has mounted on the lower half terminus, a discharge cone. The discharge cone has a lower end, there being mounted on the lower end, a discharge nozzle. Another embodiment of the invention is a magnetic separator apparatus comprising a second bellows, which is a balance bellows. The magnetic separator of this embodiment is very similar to the first embodiment set forth above except for the balance bellows and the placement of the vibrating mechanism and the upper and lower control springs.

Thus, there is a pressure vessel container having a top half, a lower half, and a lower half terminus. The pressure vessel container is surmounted by a pressure vessel lid flange as in the first embodiment, and the pressure vessel container has a vertical wall. The pressure vessel lid flange has a centered opening through it and there is a shaft seal located in the centered opening.

There is at least one feed nozzle mounted on the pressure vessel container for feeding material to the pressure vessel container and depending partly on the material to be separated, there can be two or more such feed nozzles.

As in the first embodiment, there is a matrix located in the lower half of the pressure vessel container. The matrix is supported in the pressure vessel container as a cartridge that is fixed to the shaft. There is an electromagnetic apparatus encircling the pressure vessel container on the outside of the pressure vessel container wall, and essentially at the location of the matrix as it is supported in the pressure vessel container. There is a layer of thermal insulation located between the electromagnetic apparatus and the pressure vessel container wall.

The pressure vessel lid flange has a first support mechanism mounted on it for supporting at least one lower control spring support mechanism and lower control spring above it. Also, there is a second support mechanism surmounted on the lower control spring support mechanism, wherein the second support mechanism supports a magnet vibrator casing containing a magnet vibrator.

The magnet vibrator and magnet vibrator casing have centered openings through them and there is surmounted on the magnet vibrator casing, a third support mechanism. There is mounted on the third support mechanism at least one upper control spring support mechanism and at least one upper control spring.

As in the first embodiment, there is a containment bellows surmounted on the pressure vessel lid flange that is supported by an upper support mechanism that surrounds a unitary moveable vertical shaft that is described infra.

The fourth support mechanism surmounted on the upper control spring support mechanism is surmounted by a top support plate, wherein the top support plate supports the balance bellows eluded-to Supra. The balance bellows is attached to the shaft on a flange that is integral to the unitary moveable vertical shaft.

The unitary moveable vertical shaft has a lower end and an upper end and the unitary moveable vertical shaft is held at its lower end by the matrix plate. Further, the unitary moveable vertical shaft extends upwardly through the pressure vessel lid flange centered opening and the shaft seal located in the pressure vessel lid flange, extends upwardly through the center of the containment bellows, extends upwardly through the lower control spring and lower control spring support mechanism, extends upwardly through the magnet vibrator centered opening, extends upwardly through the upper control spring support mechanism and upper control spring, and extends upwardly through the balance bellows and terminates below the lower surface of the top support plate.

Located in the pressure vessel lid flange is an inert gas purge apparatus which purge opens into a purge space formed by the shaft seal as the floor, the pressure vessel lid flange as the side and the lower containment bellows as the top, there being, a small opening where the shaft seal meets the unitary vertical shaft to enable the inert gas to flow into the pressure vessel container. In this embodiment, as opposed to the first embodiment, there is a pressure balancing tube, the pressure balancing tube being openly connected from the lower containment bellows to the upper balance bellows.

In addition, the pressure vessel has mounted on the lower half terminus, a discharge cone, the discharge cone having a lower end, there being mounted on the lower end of the discharge cone, a discharge nozzle.

A further embodiment of this invention is a process of treating silicon-containing solid material used in a reactor for producing chlorosilanes. The process comprises subjecting the silicon-containing solid material that has been used in a reactor, to a magnetic separator apparatus as set forth herein to separate constituents in the silicon-containing solid material into a magnetic portion and a non-magnetic portion.

Still another embodiment of this invention is a process of treating silicon-containing solid material. The process comprises removing silicon-containing solid material from a fluid bed of a fluid bed reactor and subjecting the silicon-containing solid material to a magnetic separator apparatus as set forth herein to separate constituents in the silicon-containing solid material into a magnetic portion and a non-magnetic portion and thereafter, returning the non-magnetic portion of the silicon-containing solid material to a fluid bed of a fluid bed reactor.

Also an embodiment of this invention is a process for the manufacture of chlorosilanes. The process comprise treating silicon-containing solid materials that have been used in a reactor that is used for the manufacture of chlorosilanes, by subjecting the silicon-containing solid materials to a magnetic separator apparatus as set forth herein to separate constituents in the silicon-containing solid material into a magnetic portion and a non-magnetic portion and thereafter, removing the magnetic portion of the silicon-containing solid materials from the reactor.

Yet another embodiment of this invention is a process for the preparation of chlorosilanes. The process comprises providing a fluid bed reactor, charging the fluid bed reactor with comminuted silicon, at least one catalyst for a Direct Process reaction, and, at least one promoter for the Direct Process reaction.

Thereafter, providing an alkyl chloride to the fluid bed reactor to form a fluid bed in the reactor allowing the comminuted silicon, catalyst, promoter and alkyl chloride to interact and react to produce alkylchlorosilanes at a desired ratio and at a desired rate.

Thereafter, upon a certain increase in the desired ratio or a certain reduction in the desired reaction rate, subject the contents of the fluid bed to a process comprising treating the fluid bed contents by subjecting the fluid bed contents to a magnetic separator apparatus as set forth herein to separate constituents in the fluid bed contents into a magnetic portion and a non-magnetic portion and removing the magnetic portion of the fluid bed contents from the process.

Going to yet another embodiment of this invention, there is a process for the preparation of chlorosilanes comprising providing a fluid bed reactor and charging the fluid bed reactor with comminuted silicon, at least one catalyst for a Direct Process reaction, and at least one promoter for the Direct Process reaction.

Thereafter, providing an alkyl chloride to the fluid bed reactor to form a fluid bed in the reactor and allowing the comminuted silicon, catalyst, promoter and alkyl chloride to interact and react to produce alkylchlorosilanes at a desired ratio and at a desired rate, and thereafter, upon a certain increase in the desired ratio or a certain reduction in the desired reaction rate, subject the contents of the fluid bed to a process comprising treating the fluid bed contents by comminuting the fluid bed contents to reduce the average particle size of the solids therein and thereafter, subjecting the milled fluid bed contents to a magnetic separator apparatus as set forth herein to separate constituents in the fluid bed contents into a magnetic portion and a non-magnetic portion and thereafter, removing the magnetic portion of the fluid bed contents from the process and continuing the Direct Process.

Still further, there is an embodiment of this invention that comprises providing a fluid bed reactor and charging the fluid bed reactor with comminuted silicon, at least one catalyst for a Direct Process reaction, and at least one promoter for the Direct Process reaction, and thereafter, providing an alkyl chloride to the fluid bed reactor to form a fluid bed in the reactor.

Thereafter, allowing the comminuted silicon, catalyst, promoter and alkyl chloride to interact and react to produce alkylcylchlorosilanes at a desired ratio and at a desired rate thereafter, upon a certain increase in the desired ratio or a reduction in the desired reaction rate, subject the contents of the fluid bed to a process comprising treating the fluid bed contents by reducing and removing impurities from the solids portion of the fluid bed contents by subjecting the fluid bed contents to a size classification method using an aerodynamic centrifugal classifier process and thereafter subjecting the purified fluid bed contents to a magnetic separator apparatus as set forth herein to separate constituents in the fluid bed contents into a magnetic portion and a non-magnetic portion and removing the magnetic portion of the fluid bed contents from the fluid bed reactor and continuing the Direct Process.

Turning to yet another embodiment of this invention, there is a process for the preparation of chlorosilanes wherein the process comprises providing a fluid bed reactor, charging the fluid bed reactor with comminuted silicon, at least one catalyst for a Direct Process reaction, and at least one promoter for the Direct Process reaction and thereafter, providing an alkyl chloride to the fluid bed reactor to form a fluid bed in the reactor.

Thereafter, allowing the comminuted silicon, catalyst, promoter and alkyl chloride to interact and react to produce alkylchlorosilanes at a desired ratio and at a desired rate and thereafter, upon a certain increase in the desired ratio or a reduction in the desired reaction rate, subject the contents of the fluid bed to a process comprising treating the fluid bed contents by comminuting the fluid bed contents to reduce the average particle size of the solids therein and reducing and removing impurities from the milled solids portion of the fluid bed contents by subjecting the fluid bed contents to a size classification method using an aerodynamic centrifugal classifier process and then subjecting the purified fluid bed contents to a magnetic separator apparatus as set forth herein to separate constituents in the fluid bed contents into a magnetic portion and a non-magnetic portion and then removing the magnetic portion of the fluid bed contents form the fluid bed of the fluid bed reactor and continuing the Direct Process.

And, finally there is an embodiment of this invention in which there is a process for the preparation of chlorosilanes wherein the process comprises providing a fluid bed reactor and charging the fluid bed reactor with comminuted silicon, at least one catalyst for a Direct Process reaction, and at least one promoter for the Direct Process reaction.

Thereafter, providing an alkyl chloride to the fluid bed reactor to form a fluid bed in the reactor and allowing the comminuted silicon, catalyst, promoter and alkyl chloride to interact and react to produce alkylchlorosilanes at a desired ratio and at a desired rate and thereafter, upon a certain increase in the desired ratio or a certain reduction in the desired reaction rate, subject the contents of the fluid bed to a process comprising treating the fluid bed contents by abrading the fluid bed contents to remove impurities from the surface of the fluid bed contents particle and thereafter, subjecting the abraded fluid bed contents to a magnetic separator apparatus as set forth herein to separate constituents in the fluid bed contents into a magnetic portion and a non-magnetic portion and thereafter, removing the magnetic portion of the fluid bed contents form the process and continuing the Direct Process.

DETAILED DESCRIPTION OF THE INVENTION

With more specificity, the invention disclosed and claimed herein is a magnetic separator apparatus that is useful in separating finely divided solids, that are suspended in or are contacted by liquids, vapors, and gases that are hazardous.

Referring now to FIG. 1, wherein there is shown a magnetic separator apparatus 1 of this invention mounted on a metal support stand 72, there is also shown a pressure vessel container 2, surmounted by a pressure vessel lid flange 5. Mounted on the pressure vessel lid flange 5 is a first support mechanism 14 that has four legs, but which is illustrated and shown as two legs 39.

The first support mechanism 14 has surmounted on its top, a plate 40, which is part of a mechanism for supporting lower springs 18. Supported on the plate 40 is a second support mechanism 17 that also has four legs, but which is illustrated as two legs 41, and mounted on this support mechanism 17 is a magnet vibrator 15 (also shown in FIG. 2).

Surmounted on the legs 41 is a plate with a second set of upper springs, designated 24. At a point just above the pressure vessel lid flange 5, there is shown a bellows 28, which is mounted on the top 43 of the pressure vessel lid flange 5. For purposes of this invention, the bellows 28 is a true pressure retaining bellows, meaning that it is not just a boot that is used as a cover.

Figure 2:
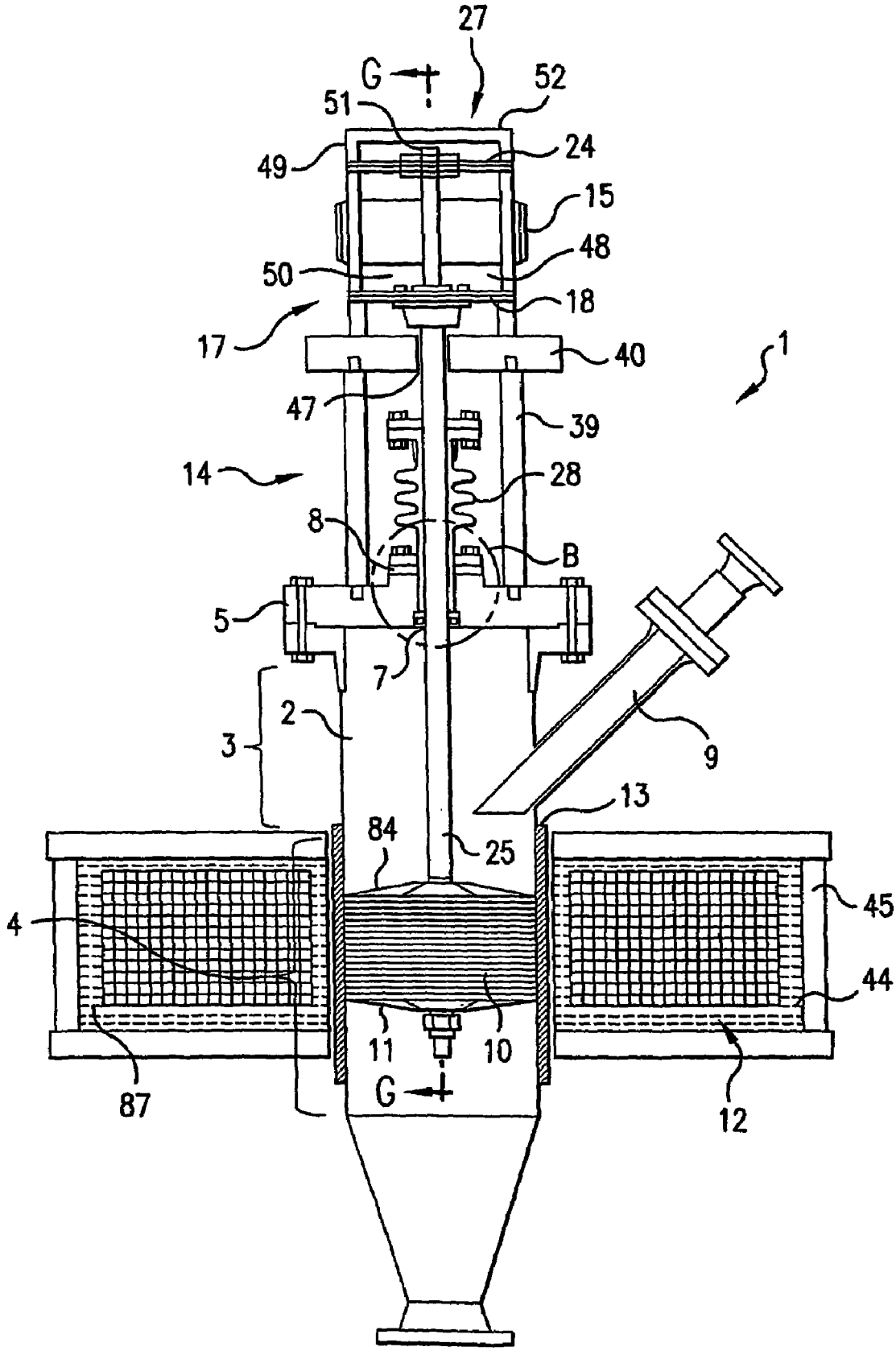
FIG. 2 is a cross sectional view of the separator of FIG. 1 through line A-A minus the support stand.

Turning to FIG. 2, which is full cross sectional view through line A-A of FIG. 1, absent the support stand 72, wherein like numbers denote like components, there is shown the pressure vessel container 2, and the top half 3 of the pressure vessel container 2, along with the lower half 4 of the pressure vessel container 2. Located in the top half 3 there is shown a feed nozzle 9 that is used to feed materials to the pressure vessel container 2.

Located in the lower half 4 of the pressure vessel container 2 is a matrix 10 that is supported within the pressure vessel container 2 as a matrix cartridge. Surrounding the pressure vessel 2, at about the same location as the matrix 10, is a layer of insulation 13 that helps control the temperature of the electromagnet apparatus housing 45 by shielding the housing from the hot pressure vessel container 2. Also within the electromagnetic apparatus housing 45 is the electromagnetic apparatus 12.

Running in a vertical line designated as line G-G in FIG. 2, is a unitary vertical shaft 25. The shaft 25 extends upwardly through the matrix cartridge, and then upwardly through the center of the pressure vessel container 2, continuing upwardly through the shaft seal 8 which is located in the centered opening 7 of the pressure vessel lid flange 5, and then through the center of the bellows 28, and then upwardly through the centered opening 47 of the plate 40, then attached to the lower control spring 18, continuing to an attachment to the moving portion of the vibrator 15, and finally then to the attachment to the upper control spring 24 and then terminating a short distance below the endplate 52. The shaft 25 moves up and down to vibrate the matrix 10 that is connected to the shaft by the plates 11 and 84.

Figure 3A:
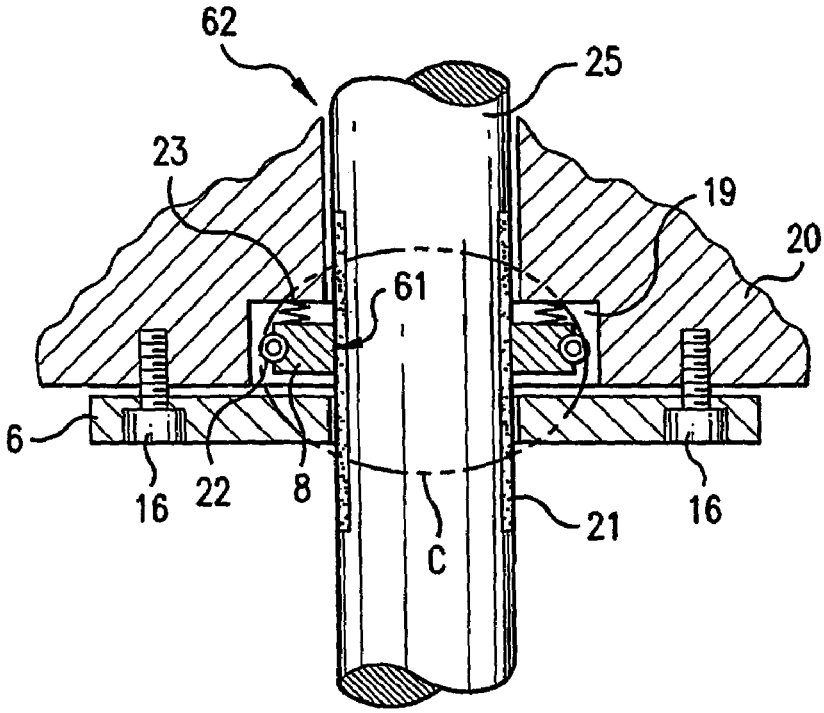
FIG. 3A is an enlarged, detailed view of the area designated B on FIG. 2.

FIG. 3A is an enlarged, detailed view of the area designated B on FIG. 2 showing the detail of the shaft seal 8. There is shown a retaining plate 6 held in place with bolts 16 that hold the shaft seal 8 in place. Shown on the outside surface of the shaft 25 at this point is a hard coat surface 21 with a polished surface. Also shown is a circumferential coil spring 22 holding the shaft seal 8 in compression around the shaft 25. In addition, there are vertical coil springs 23 surmounted on the shaft seal 8.

Figure 3B:
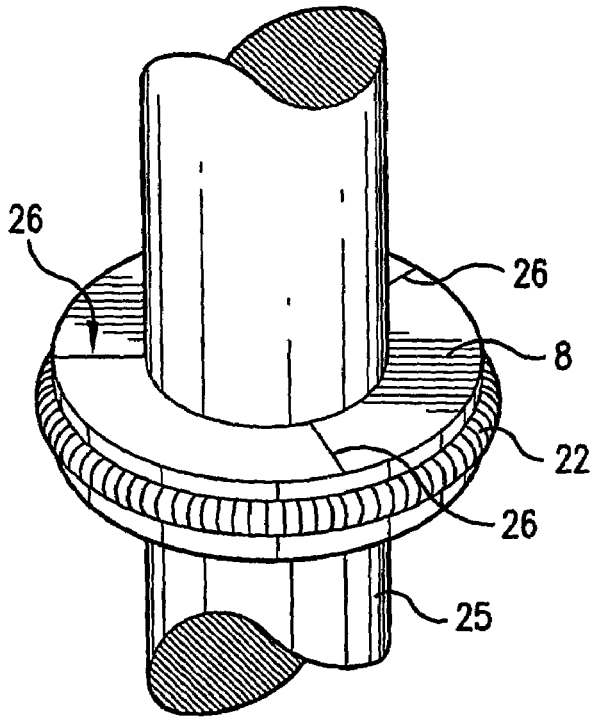
FIG. 3B is an enlarged view in perspective of the area C of FIG. 3A showing the positioning of a circumferential coil spring around the shaft seal.

FIG. 3B is an enlarged view in perspective of the area C of FIG. 3A showing the positioning of the circumferential coil spring 22 around the shaft seal. The shaft seal 8 is preferably a carbon, segmented bushing, and the segment lines can be observed in FIG. 3B at 26.

Figure 4:
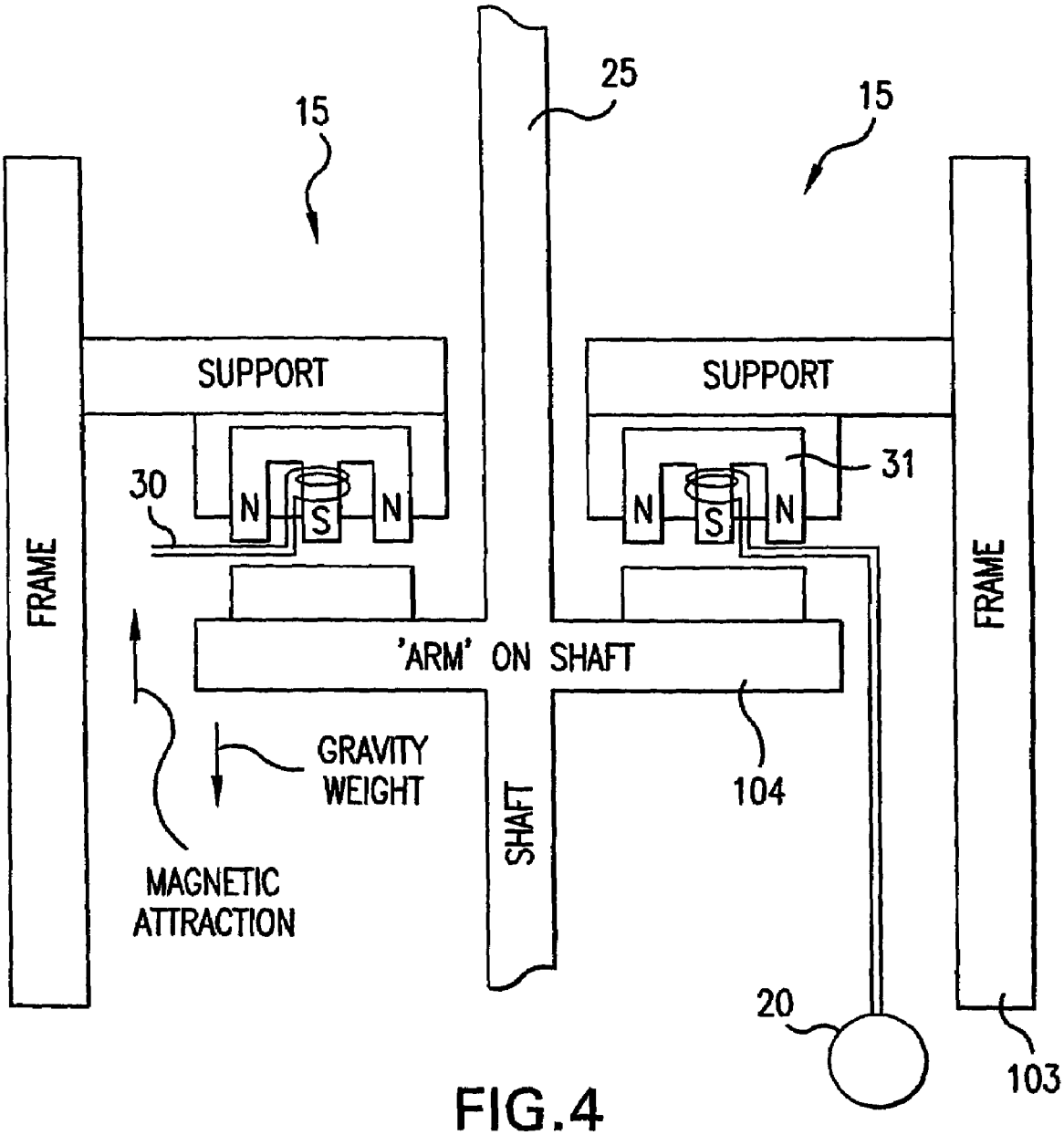
FIG. 4 is a schematic view of a vibrator.
Figure 5:
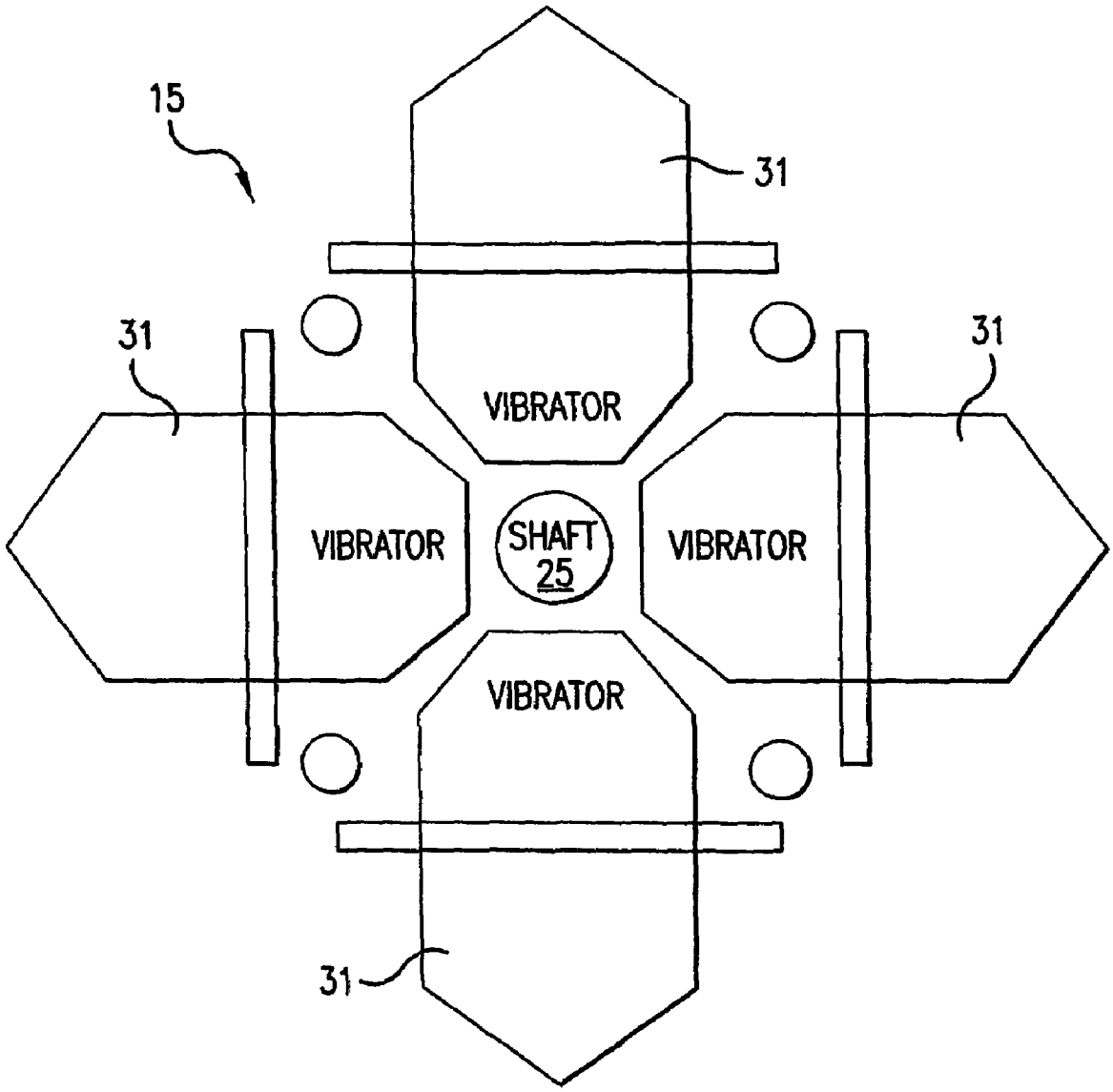
FIG. 5 is a schematic top view of the vibrator of FIG. 4.

Turning now to FIG. 4, which is an enlarged, schematic side view that is a detailed view of the vibrator 15 of this invention, through line H-H of FIG. 1, there is shown a conventional vibrator having variable, pulsed DC source 20 with wire leads 30 that supply the energy to drive the vibrator 15. Reference should also be made to FIG. 5, which is a schematic top view of the vibrator 15, showing, in this case, a vibrator 15 composed of four vibrator mechanisms 31. It should be noted that each of the mechanisms 31 are configured alike, and each have energy input through power source as illustrated at 20 of FIG. 4.

Figure 6:
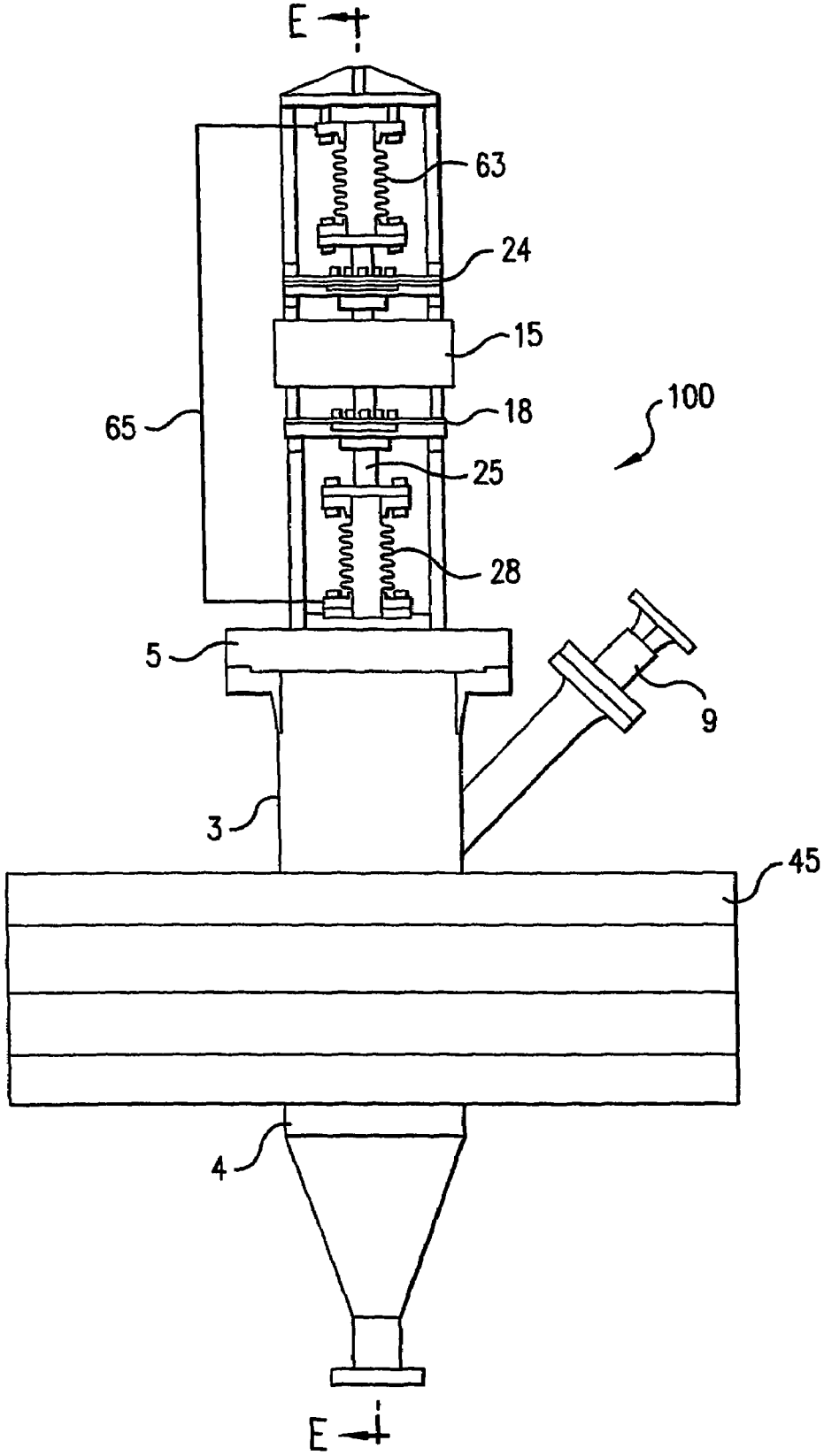
FIG. 6 is a full front view of another embodiment of this invention which is a separator showing both the containment bellows and the balance bellows in position, with the feed tube from the balance bellows to the containment bellows.

Turning now to FIG. 6, there is shown a full front view of another embodiment of this invention which is a separator 100, wherein like designations indicate like components as in FIGS. 1 and 2, showing both the containment bellows 28 and the balance bellows 63 in position, with a pressure equalization tube 65 from the balance bellows 63 to the containment bellows 28.

Figure 7:
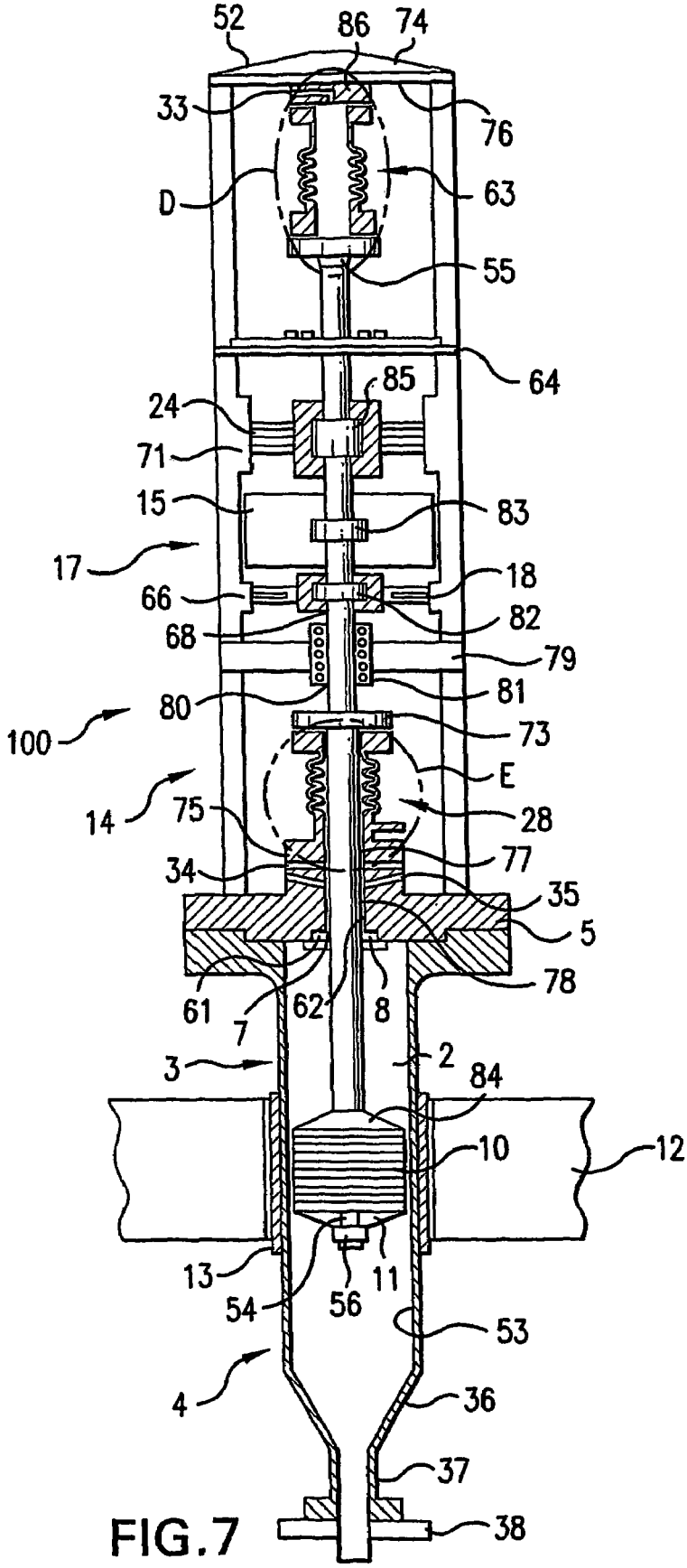
FIG. 7 is a cross sectional view of FIG. 6 through the line E-E of FIG. 6.

With reference to FIG. 7, which is a cross-sectional side view of the separator 100 of FIG. 6 through line E-E of FIG. 6, minus the feed nozzle 9, wherein there is shown an inlet/outlet 33 from the balance bellows 63, and an inlet/outlet 34 from the containment balance 28 that allows for pressure equalization between the two bellows through the balance tube 65 (not shown in FIG. 7, but is shown in FIG. 6).

Also shown is a gas inlet 35. It should be noted that there is a small gap or opening 61 around the shaft 25, which allows for the flow of the gas into and out of the purged space.

In the upper balance bellows 63, the pressure thrust forces from the lower bellows 28 are balanced. The primary bellows is the lower containment bellows 28. The bellows 63 is constructed similar to the bellows 28, and it is located above the upper control spring 24 using a support mechanism that is similar to the support mechanisms used therebelow.

The pressure balance tube 65 provides an open flow of gas between the balance bellows 63 and the containment bellows 28. When the containment bellows 28 is compressed, the balance bellows 63 is extended and vice versa.

As in the vibrating magnetic separator 1 of FIG. 1, in this separator, there is shown the pressure vessel 2, the top half 3 and the lower half 4 of the pressure vessel 2, showing the vertical wall 53 on which the feed nozzle 9 is mounted, the pressure vessel lid flange 5, the centered opening 7 in the pressure vessel lid flange 5, the shaft seal 8 in the centered opening 7, the matrix 10, the matrix support plate 11, the electromagnetic apparatus 12, with the surrounding insulation layer 13 and a first support mechanism 14.

The top of the flange 5 is configured with a platform 75 that is shown as an integral part of the flange 5, which supports the containment bellows 28. The platform 75 has a centered opening 77 in it that allows for the passage of the shaft 25 therethrough.

The upper end of the containment bellows 28 is attached to an integral flange 73 on the shaft 25.

Optionally, the separator 100 can contain a plate 79, supported on the support mechanism 14, that has a centered opening 80, in which is situated a linear bearing 81 for the shaft 25. Just above the plate 79, is the bottom control spring 18, which is held in place by support 66. The bottom control spring 18 is attached to shaft 25 at flange 82. In this manner, the bottom control spring 18 controls the vertical movement of the shaft 25 and prevents lateral movement of the shaft 25.

Situated just above the bottom control spring 18 is the vibrator 15 that is supported by the support mechanism 17. The shaft 25 contains a flange 83 at this point such that the vibrator 15 can be connected with the shaft 25 to enable the shaft 25 to be vibrated up and down in the separator. Just above the vibrator 15, is located the top control spring 24. The shaft 25 has an expanded portion 85 at this point to enable the top control spring 24 to control the shaft 25. Just above the top control spring 24, is the top end of the separator 100 in which there is located the balance bellows 63, supported by a flange 55 in the shaft 25. As indicated Supra, there is a blind flange closure 86 for the bellows 63 that prevents the bellows 63 from moving upwardly. In the top end of the balance bellows 63 there is located the inlet/outlet 33. Thereafter, there is a top plate 74 to bind the component parts of the separator 100 at the top.

The unitary moveable vertical shaft 25 has a lower end 54 and an upper end 55. The matrix cartridge is fitted to the lower end of the shaft. The unitary moveable vertical shaft 25 extends upwardly through the pressure vessel lid flange 5, centered opening 7 and the shaft seal 8 located in the pressure vessel lid flange 5. The shaft 25 then extends upwardly through the center of the containment bellows 28, further extending upwardly where it is attached to the lower control spring 18 and lower control spring support mechanism, extending upwardly through the vibrator centered opening 16, extending upwardly through the upper control spring support mechanism 71 where it is attached to upper control spring 24, and extending upwardly through the balance bellows 28 and terminating below blind flange closure 86.

There is a clean gas purge apparatus 77 comprising an clean gas purge inlet 35 located in the pressure vessel lid flange 5, which purge opens into a purge space 62 formed by the shaft seal 8 as the floor, the pressure vessel lid flange 5 as the side and the containment bellows 28 as the top, there being a small opening 61 where the shaft seal 8 meets the unitary vertical shaft 25 to enable the inert gas to flow into the pressure vessel container 2.

For purposes of balancing the pressure between the two bellows, there is pressure balancing tube 65, that is openly connected from the containment bellows 28 to the balance bellows 63.

At the bottom of the separator 100, the pressure containment vessel 2 has mounted on its lower half terminus, a discharge cone 36, which discharge cone 36 has a lower end 37, and affixed on the lower end 37 is a discharge nozzle 38.

In operation, and with reference to the first embodiment of this invention, the magnetic separator 1 consists of the matrix 10 that vibrates inside the pressure vessel container 2. The matrix 10 is intermittently magnetized and demagnetized by means of the electromagnetic apparatus 12 that surrounds the matrix 10. The matrix 10 is vibrated by means of the moveable vertical shaft 25. To allow the separator 1 to operate at temperatures above ambient temperature and pressure, the bellows 28 is preferentially constructed of thin flexible metal.

Figure 9:
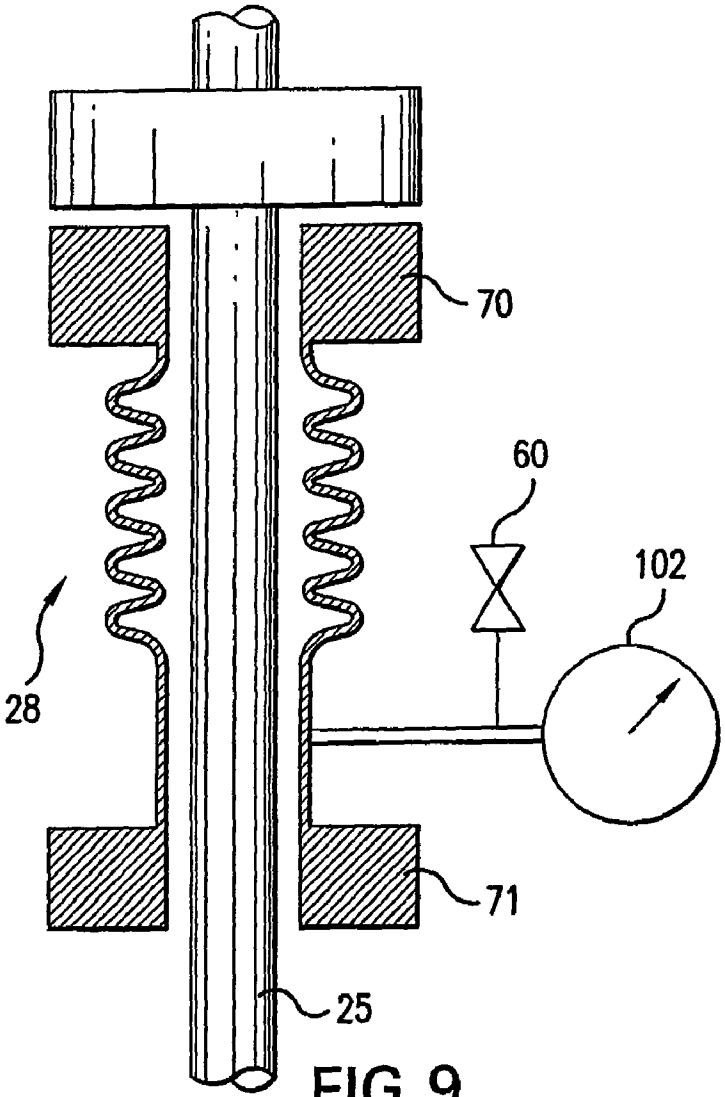
FIG. 9 is a full view of the containment bellows of FIG. 7, area E.
Figure 8:
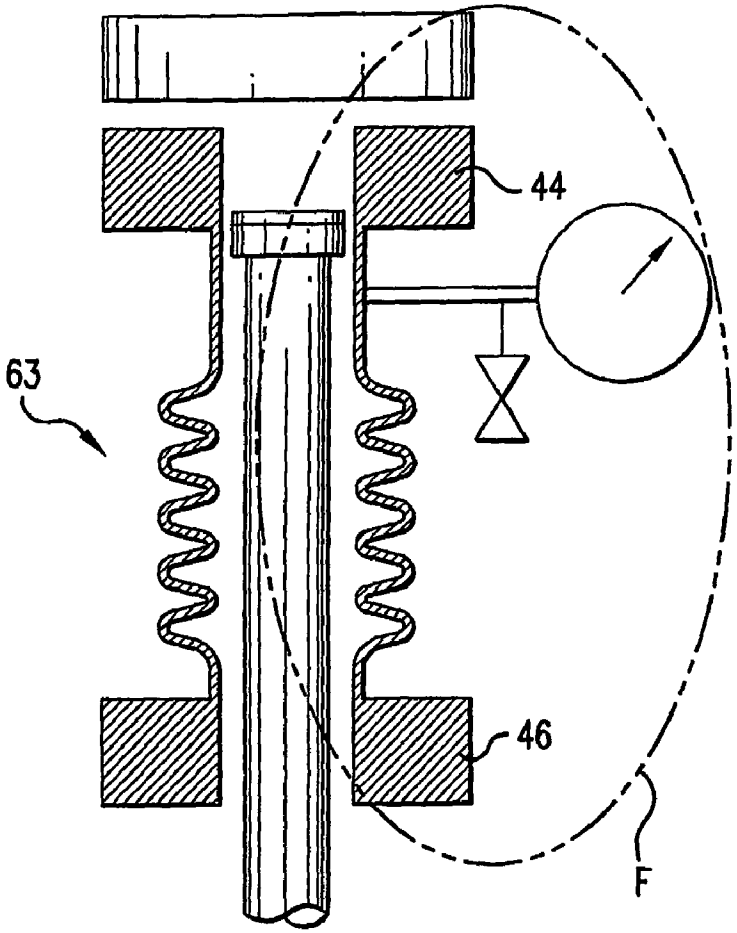
FIG. 8 is a full view of the balance bellows of FIG. 7, area D.

FIG. 8 is a view of the area D of FIG. 7, and FIG. 9 is a view of the area E of FIG. 7.

Figure 10:
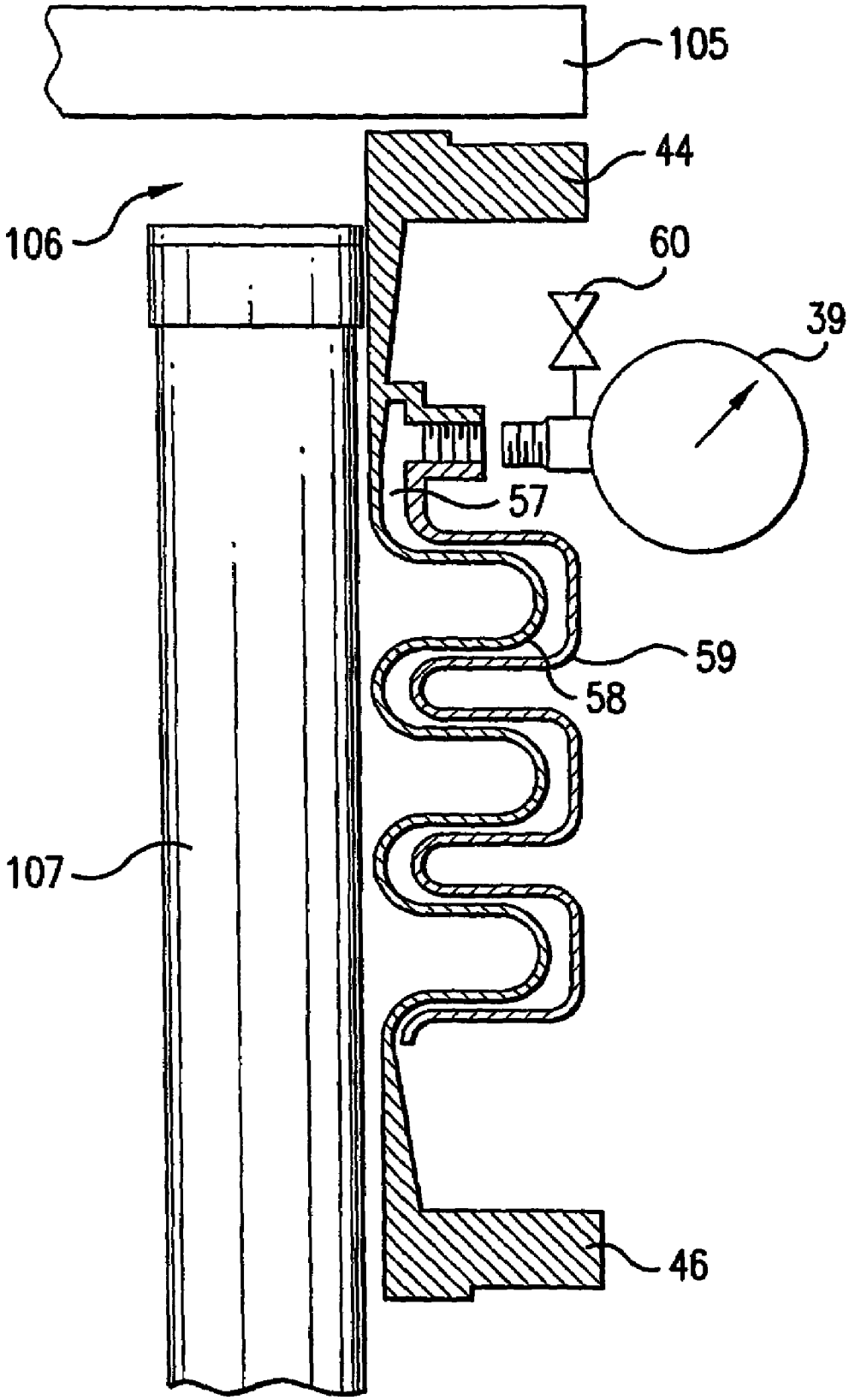
FIG. 10 is an enlarged view of about ½ of the balance bellows in area F of FIG. 8.

FIG. 10 is an enlarged Figure and detail of the area F of FIG. 8, which is a portion of the balance bellows 63. The Figure shows a portion of the shaft 25, the outer most ply 59 and the inner most ply 58 of the bellows. There is shown the top flange 44 of the bellows and the lower flange 46 of the bellows, the operation of which is set forth infra. There is also shown a pressure instrument 39, a pressure measuring chamber 57, and a vacuum valve 60. The containment bellows 28 is constructed in a similar manner, but as can be observed from FIG. 9, the pressure instrument 39, the pressure measuring chamber 57, and vacuum valve 60 are shown at the bottom of the bellows.

For purposes of illustration and clarity of operation of the separators, the flanges on the two bellows have been denominated differently. In the balance bellow 63, the top flange is designated 44 and this is the stationary flange, while the bottom flange is designated 46 which is the flange that moves when the bellows expands and contracts.

Likewise, in FIG. 9, the containment bellows is illustrated as shown in area E of FIG. 7 wherein the top flange is designated 70 and is the moving flange, while the bottom flange is designated 71 and is the stationary flange and operates the same as the balance bellows 28.

A multi-ply metal bellows is preferred because it allows a higher level of structural integrity. A multi-ply metal bellows 28 also allows the integrity of the bellows 28 to be tested continuously for failure. What is meant by "multi-ply" is at least two walls. The bellows 28 is preferably a corrugated tube design as is shown in the Figures. The walls of the multi-ply bellows 28 are concentric. A pressure-sensing chamber 57 as shown in FIG. 10 is created between the innermost and outermost plies 58 and 59 of the bellows. This chamber can be evacuated by means of the valve 60 that has been connected to a vacuum pump (not shown). The pressure in the chamber 57 can then be read directly from the pressure instrument 39. This pressure instrument 39 can be a locally mounted pressure gauge as illustrated herein, but preferably, it is an electronic pressure sensor that is connected to a control system such as a programmable logic controller or distributed control system with an alarm to alert the operator immediately in case either of the bellows fail. The pressure sensing chamber 57 can be pressurized or evacuated, but the pressure must be different than either the external ambient pressure or the pressure inside the pressure vessel 2. In the case of a magnetic separator operating above ambient pressure, the chamber 57 is preferentially evacuated so that failures, cracks or leaks in the outer ply 59 of the bellows or the inner ply 58 of the bellows are detected when the pressure in the sensing chamber 57 rises above a predetermined vacuum alarm point. If the pressure vessel 2 is operating under vacuum, it may be desirable to pressurize the inter-ply pressure-sensing chamber 57. In this case, additional stiffness in the bellows due to the pressure between the plies must be considered in designing the bellows.

With regard to the second embodiment of this invention, wherein a second bellows, the balance bellows 63, is used as shown in FIG. 6, the pressure thrust forces are equalized between the two bellows. The containment bellows 28 is balanced with the balance bellows 63. When the containment bellows 28 is compressed, the balance bellows 63 is extended and vice versa. In the first embodiment, high pressure in the pressure vessel 2 acts on the containment bellows 28 creating an upward force. If the pressure is high, the resulting force can be considerable. The pressure vessel 2 pressure also acts on the cross sectional area of the vertical moveable shaft 25. A small pressure force can result from a purge of clean gas on the shaft seal. In the second embodiment, a pressure balance tube 65 creates an equal pressure on the balance bellows 63 with an equal downward force. The upward force of the containment bellows 28 and the downward force of the balance bellows 63 cancel each other. This decreases the load on the vibrator 15 and the springs 18 and 24. The balanced bellows design is particularly suite for variable pressures in the pressure vessel 2.

The vibrating assembly per se consists essentially of the vertical moveable shaft 25 and the matrix 10. The vertical moveable shaft 25 is suspended on multiple springs 18 and 24. Coil springs can be used, but to limit lateral deflections, these springs are preferably leaf springs so that the lateral deflections can be controlled to prolong the life of the bellows, in other words, the lateral deflections should be limited as much as is possible. Leaf springs improve deflection control and alignment of the shaft through the opening. The springs 18, 24, for example, can be made of any suitable material such as steel or glass reinforced plastic. Multiple springs can be used at both the top and the bottom locations in the stacks. To minimize lateral deflections, the stacks of leaf springs can be rotated ninety degrees in orientation. It is preferred to make the bolted and bolted and flanged components self aligning with alignment grooves or alignment marks.

The vertical moveable shaft 25 is vibrated vertically by means of the linear "E-frame" vibrator 15. The E-frame vibrator 15 is connected to an AC or pulsed DC power source that creates oscillating vertical vibration according to the frequency of the AC or pulsed DC power source.

A purge, which can be inert or not, can optionally be applied to reduce the risk of premature failure of the thin-walled bellows due to erosion damage from abrasive powders. In addition to erosion, solids in the bellows area can fill the bellows so that it is packed with solids and therefore inflexible. The purge can also prevent condensation of vapors that are handled above their boiling point in the pressure vessel. In this case, a clean gas or some other suitable fluid flows through a purge pipe inlet 35 into a purge space 62 above the pressure vessel 2. The upper flange 70 of the bellows 28 encloses the top of the purge space 62. The lower end of the purge space 62 is partially open to the pressure vessel 2 through the small opening 61 where shaft seal 8 meets the unitary vertical shaft 25. The purge space 62 is machined into the pressure vessel lid flange 5 and the space is fitted with a shaft seal 8 that is fitted into the pressure vessel lid flange 5. The shaft seal 8 is shaped like a washer. It is made of a material of construction that is distinctly harder or softer than the vertical shaft 25 so that one component is preferentially worn and replaced with respect to the other. The shaft seal 8 can be a single piece washer or a segmented bushing. The preferred design is a graphite shaft seal and an alloy shaft. Harder shaft seals 8 made of silicon carbide or similar ceramics are also possible. The shaft seal 8 prevents ingress of fine, abrasive particles. It also provides a preferential wear point so that that inexpensive shaft seal 8 can be replaced instead of a more difficult repair of the pressure vessel lid flange 5 or shaft 25. The shaft seal 8 can be fitted from below as shown, or alternatively, it can be fitted from above.

The matrix 10 is assembled in a matrix carrier and fixed to the vibrating shaft 25 by means of upper and lower plates 11 and 84, respectively, that are clamped to the vertical moveable shaft 25. Many types of matrices 10 are possible such as screens, perforated plates, expanded metal mesh or even steel wool. The preferred matrix 10 is a partially opened disk such as an expanded metal mesh. The matrix 10 is made from magnetically soft steels such as, for example, 430 stainless steel or 410 stainless steel.

The matrix 10 is alternatively magnetized and demagnetized by an external electromagnetic apparatus 12 such as a solenoid, and the solenoid is housed in a housing 45. The housing 45 is filled with oil 87 (FIG. 2) that is cooled externally by means of a circulation and volume expansion system not shown and not part of the claimed invention.

If the pressure vessel 2 is to operate significantly above ambient temperature, it is desirable to fit the unit with thermal insulation 13. This prevents the housing 45 from overheating so that the solenoid 12 resistance increases and causes reduced magnetic field strength. Preferred materials of construction for the pressure vessel 2 and the vertical moveable shaft 25 are steels such as 304 and 316 stainless steels. These steels are not significantly magnetized by the solenoid 12. To improve wear resistance, a non-magnetic hard coating 21 can be applied to the containment vessel 2, shaft 25, and other components.

Powder containing magnetic particles is fed through feed nozzle 9. Multiple nozzles may be provided to equalize flow to different sides of the vessel. If the feed powder is especially abrasive, it is desirable to insert feed pipes through the nozzles so that pipes can be replaced without significant repair to the pressure vessel. If the pressure vessel 2 is a large diameter vessel, it may be desirable to provide a steep discharge cone 36 to limit the size of the downstream collection and transfer piping.

To process a batch of feed powder, the solenoid 12 is first energized to magnetize the matrix 10. Then, a volume of powder is fed through the feed nozzle 9 onto the top of the matrix 10. The feed powder flows through the matrix plates 10 aided by the vibrator 15. Magnetic particles are attracted to the matrix 10. Non-magnetic particles pass through the matrix 10 and discharge through the discharge nozzle 38.

After non-magnetic particles are removed from the separator, a diverter valve below the separator (not shown) is switched to direct flow to a different piping route. Then, the solenoid 12 is de-energized. With the vibrator 15 still operating, the magnetic fines are released from the matrix 10 and exit the discharge nozzle 38.

Suitable materials of construction for the metal bellows 28 and 63 are austenitic stainless steels such as 316 stainless steel or high nickel alloys such as Inconel 625 or Hastelloy C22. The preferred material is Hastelloy C22. The materials of construction for the inner ply bellows 58 must be compatible with the contents of the magnetic separators. The materials of construction for the outer ply 59 of the bellows 28 and 63 must be compatible with the external environment and weather, if the separators are located outdoors.

What is claimed is:

1. A vibrating magnetic separator comprising in combination:

A. an electromagnet;

B. a pressure vessel having an inlet and an outlet, said pressure vessel being mounted in the electromagnet;

C. a ferromagnetic matrix;

D. a vibrator for vibrating the ferromagnetic matrix said vibrator moving in a vertical direction, and E. a bellows that connects the stationary components of the magnetic separator to the vibrating components of the magnetic separator and seals the process contents from leaking to the atmosphere, said bellows having at least two plies.

2. A vibrating magnetic separator as claimed in claim 1 wherein the means of applying vibration to the matrix is a moveable shaft connecting the vibrator and the matrix.

3. A vibrating magnetic separator as claimed in claim 1 wherein the flexible bellows is a metal bellows that is useful above ambient temperature and pressure.

4. A vibrating magnetic separator as claimed in claim 1 wherein there is present between two of the plies, failure detection means.

5. A vibrating magnetic separator as claimed in claim 1 wherein there is present at least one linear vibrator.

6. A magnetic separator apparatus comprising in combination:

a. a pressure vessel container having a top half, a lower half, and a lower half terminus, said pressure vessel container being surmounted by a pressure vessel lid flange said pressure vessel container having a vertical wall, said pressure vessel lid flange having a centered opening therethrough wherein there is a shaft seal located in said centered opening;

b. at least one feed nozzle mounted on the pressure vessel container for feeding material to the pressure vessel container;

c. a matrix located in the lower half of the pressure vessel container, said matrix being supported in the pressure vessel container as a cartridge;

d. an electromagnetic apparatus encircling the pressure vessel container on the outside of the pressure vessel container wall, and at the location of the matrix, a layer of thermal insulation located between said electromagnetic apparatus and the pressure vessel container wall;

e. a first support mechanism mounted on the pressure vessel lid flange for supporting a vibrator mounting frame, said vibrator mounting frame having a centered opening therethrough;

f. a second support mechanism surmounted on the vibrator mounting frame for supporting at least one lower control spring and lower control spring support mechanism, said second support mechanism also supporting a magnet vibrator casing containing a magnet vibrator, said magnet vibrator and magnet vibrator casing having centered openings therethrough, and surmounted on the magnet vibrator casing, a third support mechanism, there being mounted on said third support mechanism a support plate having surmounted thereon a fourth support mechanism, there being supported on the fourth support mechanism, at least one upper control spring having an upper surface;

g. a unitary moveable vertical shaft having a lower end and an upper end, said unitary moveable vertical shaft being held at its lower end by the matrix plate, said unitary moveable vertical shaft extending upwardly through the pressure vessel lid flange centered opening and the shaft sea located in the pressure vessel lid flange, extending upwardly through the center of a bellows, extending upwardly through the vibrator mounting frame centered opening, extending upwardly through the lower control spring, extending upwardly through the magnet vibrator centered opening, extending upwardly through the upper control spring, and terminating at essentially the upper surface of the upper control spring;

h. said bellows being surmounted on the pressure vessel lid flange and being supported by a bellows upper support mechanism that surrounds the unitary moveable vertical shaft;

i. an clean gas purge apparatus comprising an clean gas purge inlet located in the pressure vessel lid flange, which purge opens into a purge space formed by the shaft seal as the floor, the pressure vessel lid flange as the side and the bellows as the top, there being a small opening where the shaft seal meets the unitary vertical shaft to enable the inert gas to flow into the pressure vessel container;

j. the pressure vessel lid flange having mounted on the lower half terminus, a discharge cone, said discharge cone having a lower end, there being mounted on the lower end of the discharge cone, a controllable discharge nozzle.

7. A magnetic separator apparatus comprising in combination:

(i) a pressure vessel container having a top half, a lower half, and a lower half terminus, said pressure vessel container being surmounted by a pressure vessel lid flange said pressure vessel container having a vertical wall, said pressure vessel lid flange having a centered opening therethrough wherein there is a shaft seal located in said centered opening;

(ii) at least one feed nozzle mounted on the pressure vessel container for feeding material to the pressure vessel container;

(iii) a matrix located in the lower half of the pressure vessel container, said matrix being supported in the pressure vessel container by a matrix plate;

(iv) an electromagnetic apparatus encircling the pressure vessel container on the outside of the pressure vessel container wall, and essentially at the location of the matrix;

(v) a layer of thermal insulation located between said electromagnetic apparatus and the pressure vessel container wall;

(vi) a first support mechanism mounted on the pressure vessel lid flange for supporting at least one lower control spring support mechanism and lower control spring;

(vii) a second support mechanism surmounted on the lower control spring support mechanism, said second support mechanism supporting a magnet vibrator casing containing a magnet vibrator, said magnet vibrator and magnet vibrator casing having centered openings therethrough; and surmounted on the magnet vibrator casing, a third support mechanism, there being mounted on said third support mechanism at least one upper control spring support mechanism and at least one upper control spring;

(viii)) a containment bellows being surmounted on the pressure vessel lid flange and being supported by an upper support mechanism that surrounds a unitary moveable vertical shaft;

(ix) a fourth support mechanism surmounted on the upper control spring support mechanism, said fourth support mechanism being surmounted by a top support plate, said top support plate supporting a balance bellows, said balance bellows being supported by a lower support mechanism that surrounds the unitary moveable vertical shaft;

(x) the unitary moveable vertical shaft having a lower end and an upper end, said unitary moveable vertical shaft being held at its lower end by the matrix plate, said unitary moveable vertical shaft extending upwardly through the pressure vessel lid flange centered opening and the shaft seal located in the pressure vessel lid flange, extending upwardly through the center of the containment bellows, extending upwardly through the lower control spring and lower control spring support mechanism, extending upwardly through the magnet vibrator centered opening, extending upwardly through the upper control spring support mechanism and upper control spring, and extending upwardly through the balance bellows and terminating at essentially the lower surface of the top support plate;

(xii) a clean gas purge apparatus comprising a clean gas purge inlet located in the pressure vessel lid flange, which purge opens into a purge space formed by the shaft seal as the floor, the pressure vessel lid flange as the side and the containment bellows as the top, there being a small opening where the shaft seal meets the unitary vertical shaft to enable the clean gas to flow into the pressure vessel container;

(xiii) a pressure balancing tube, said pressure balancing tube being openly connected from the containment bellows to the balance bellows;

(xiv) the pressure vessel lid flange having mounted on the lower half terminus, a discharge cone, said discharge cone having a lower end, there being mounted on the lower end of the discharge cone, a discharge nozzle.

8. A process of treating silicon-containing solid material used in a reactor for producing chlorosilanes, the process comprising subjecting the silicon-containing solid material that has been used in said reactor, to a magnetic separator apparatus as claimed in claim 1 to separate constituents in the silicon-containing solid material into a magnetic portion and a non-magnetic portion.

9. A process of treating silicon-containing solid material, the process comprising:

(I) removing silicon-containing solid material from a fluid bed of a fluid bed reactor;

(II) subjecting the silicon-containing solid material to a magnetic separator apparatus as claimed in claim 1 to separate constituents in the silicon-containing solid material into a magnetic portion and a non-magnetic portion;

(III) returning the non-magnetic portion of the silicon-containing solid material to a fluid bed of a fluid bed reactor.

10. A process for the manufacture of chlorosilanes, said process comprising:

(I) treating silicon-containing solid materials that have been used in a reactor that is used for the manufacture of chlorosilanes by subjecting the silicon-containing solid materials to a magnetic separator apparatus as claimed in claim 1 to separate constituents in the silicon-containing solid material into a magnetic portion and a non-magnetic portion and (II) removing the magnetic portion of the silicon-containing solid materials from the reactor.

11. A process for the preparation of chlorosilanes, the process comprising:

(I) providing a fluid bed reactor;

(II) charging the fluid bed reactor with comminuted silicon;

(ii) at least one catalyst for a Direct Process reaction;

(iii) at least one promoter for the Direct Process reaction;

(III) thereafter, providing an alkyl chloride to the fluid bed reactor to form a fluid bed in the reactor;

(IV) allowing the comminuted silicon, catalyst, promoter and alkyl chloride to interact and react to produce alkylchlorosilanes at a desired ratio and at a desired rate;

(V) thereafter, upon a certain increase in the desired ratio or a certain reduction in the desired reaction rate, subjecting the contents of the fluid bed to a process comprising treating the fluid bed contents by subjecting the fluid bed contents to a magnetic separator apparatus as claimed in claim 1 to separate constituents in the fluid bed contents into a magnetic portion and a non-magnetic portion and removing the magnetic portion of the fluid bed contents from the process.

12. A process for the preparation of chlorosilanes, the process comprising:

(I) providing a fluid bed reactor;

(II) charging the fluid bed reactor with (i) comminuted silicon;

(ii) at least one catalyst for a Direct Process reaction;

(iii) at least one promoter for the Direct Process reaction;

(III) thereafter, providing an alkyl chloride to the fluid bed reactor to form a fluid bed in the reactor;

(IV) allowing the comminuted silicon, catalyst, promoter and alkyl chloride to interact and react to produce alkylchlorosilanes at a desired ratio and at a desired rate;

(V) thereafter, upon a certain increase in the desired ratio or a certain reduction in the desired reaction rate, subject the contents of the fluid bed to a process comprising treating the fluid bed contents by comminuting the fluid bed contents to reduce the average particle size of the solids therein and thereafter, subjecting the milled fluid bed contents to a magnetic separator apparatus as claimed in claim 1 to separate constituents in the fluid bed contents into a magnetic portion and a non-magnetic portion and thereafter, removing the magnetic portion of the fluid bed contents from the process and continuing the Direct Process.

* * * * *